US006230904B1

(12) United States Patent
Licari

(10) Patent No.: US 6,230,904 B1
(45) Date of Patent: May 15, 2001

(54) GARMENT HANGER PACKAGING AND DISPLAY APPARATUS

(75) Inventor: Yaffa Licari, Somerset, NJ (US)

(73) Assignee: Basic Line, Perth Amboy, NJ (US)

( * ) Notice: Subject to any disclaimer, the term of this patent is extended or adjusted under 35 U.S.C. 154(b) by 0 days.

(21) Appl. No.: 09/483,296

(22) Filed: Jan. 14, 2000

(51) Int. Cl.[7] ..... A47F 7/00
(52) U.S. Cl. ..... 211/49.1; 294/158; 206/497
(58) Field of Search ..... 206/497; 211/49.1, 211/59.1; 294/158; D6/467

(56) References Cited

U.S. PATENT DOCUMENTS

D. 392,818 * 3/1998 Shawham ..... D6/467
891,490 * 6/1908 Lippold .
2,918,174 * 12/1959 Tabbi ..... 211/49.1
3,266,688 * 8/1966 Sefton .
4,016,981 * 4/1977 Hildt ..... 211/49.1
4,424,905 * 1/1984 Keen ..... 211/49.1
4,768,658 * 9/1988 Shafto ..... 211/49.1
4,919,278 * 4/1990 Howen ..... 211/49.1
5,050,738 * 9/1991 McAdams ..... 206/497
5,833,184 * 11/1998 Scola ..... 211/49.1 X
5,871,090 * 2/1999 Doucette et al. ..... 206/497 X
5,924,578 * 7/1999 McKenzie ..... 211/49.1
6,109,457 * 8/2000 Dahnke ..... 211/49.1

* cited by examiner

*Primary Examiner*—Robert W. Gibson, Jr.
(74) *Attorney, Agent, or Firm*—Mathews, Collins, Shepherd & Gould, P.A.

(57) ABSTRACT

A hanger package and display assembly is disclosed that can be used to both package and ship hangers and also display the hangers. With this assembly, the hangers can be displayed in their own packaging in an aesthetically-pleasing manner. In one embodiment, the assembly comprises top and bottom platforms and at least two spaced-apart rods vertically disposed between the platforms. The rods are spaced-apart from each other by a sufficient distance that when a hanger is placed flat on the bottom platform, the rods are situated in the framed-space of the hanger on opposite sides of the central longitudinal axis of the hanger. In this way, the hanger is retained on the bottom platform by the rods. The two rods should be of sufficient height that a plurality of hangers can be stacked and retained by the rods between the top and bottom platforms.

8 Claims, 6 Drawing Sheets

GARMENT HANGER PACKAGING AND DISPLAY APPARATUS

FIELD OF THE INVENTION

The present invention relates to an apparatus for packaging and displaying garment hangers. With this apparatus, a large number of hangers can be packaged and then displayed in its own packaging in an aesthetically pleasing manner.

BACKGROUND OF THE INVENTION

Hangers are essential household items, and each year, large numbers of hangers are sold to consumers and thus packaged and shipped to retail stores. Due to their design, hangers are bulky and difficult to package for shipping and display in a store. Traditionally, hangers when sold to retail stores have been packaged in large cardboard boxes. A store worker then must take the hangers out of the boxes and hang them on rods for display in the store. This task is time-consuming and also creates the opportunity for unpleasant store conditions. For example, a box of hangers may be placed in an aisle for a worker to take the hangers out of the box for display. If the worker does not immediately remove all the hangers, or if the task of removing them is interrupted, hangers are left in the aisle in cardboard boxes. This can be unsightly and block the aisle from customer traffic.

The prior art shows a number of packages that include use of hangers. See, e.g., U.S. Pat. No. 5,598,922 to Good, "Product Display Hanger"; U.S. Pat. No. 4,590,610 to Rhyne, "Hanging Product Display Packages"; U.S. Pat. No. 4,834,553 to Bennett, "Plastic Film Package with a Hanger"; and U.S. Pat. No. 4,632,242, "Display Package Having a Retractable Hanger." However, it appears that none of these patents address the drawbacks associated with in-store display of hangers for the sale of the hangers themselves, as discussed above. As may be appreciated, it would be advantageous to have a packaging assembly that addresses these drawbacks.

SUMMARY OF THE INVENTION

Summarily described, the invention embraces an assembly for packaging and also displaying hangers. In one embodiment, the assembly comprises top and bottom platforms, preferably substantially planar platforms, and at least two spaced-apart rods vertically disposed between the platforms. Each of the at least two rods has a top end and a bottom end. The bottom end of each rod is mounted on the bottom platform; the top end of each rod is attached to the top platform, and preferably removably fitted to the top platform so that a consumer can easily remove the top platform from the display. The rods are spaced-apart from each other by a sufficient distance that when a hanger is placed along a plane aligned with the horizontal plane of symmetry of the bottom platform, the rods are situated in the framed-space of the hanger on opposite sides of the central longitudinal axis of the hanger. The two rods should be of sufficient height that a plurality of hangers can be stacked on the rods between the top and bottom platforms. Preferably, four rods are used and a plurality of differently-colored hangers are alternatively stacked on the rods to provide an aesthetically-pleasing display of hangers.

BRIEF DESCRIPTION OF THE DRAWINGS

For a better understanding of the invention, an exemplary embodiment is described below, considered together with the accompanying drawings, in which.

It is to be understood that these drawings are for the purposes of illustrating the concepts of the invention and are not to scale.

DETAILED DESCRIPTION OF THE INVENTION

The applicant has discovered a hanger packaging and display assembly that can be used to both package and ship hangers and also display the hangers. With this assembly, the hangers can be displayed in its own packaging in an aesthetically-pleasing manner. This invention thus avoids the need to have store workers take hangers out of boxes and hang them on rods for in-store display. Instead, a package of hangers upon being shipped to a retail store can be placed in a display area. A plastic wrap may be used to enclose the assembly, and the worker may need only remove the plastic packaging to provide consumers with access to the hangers.

Figure 1:
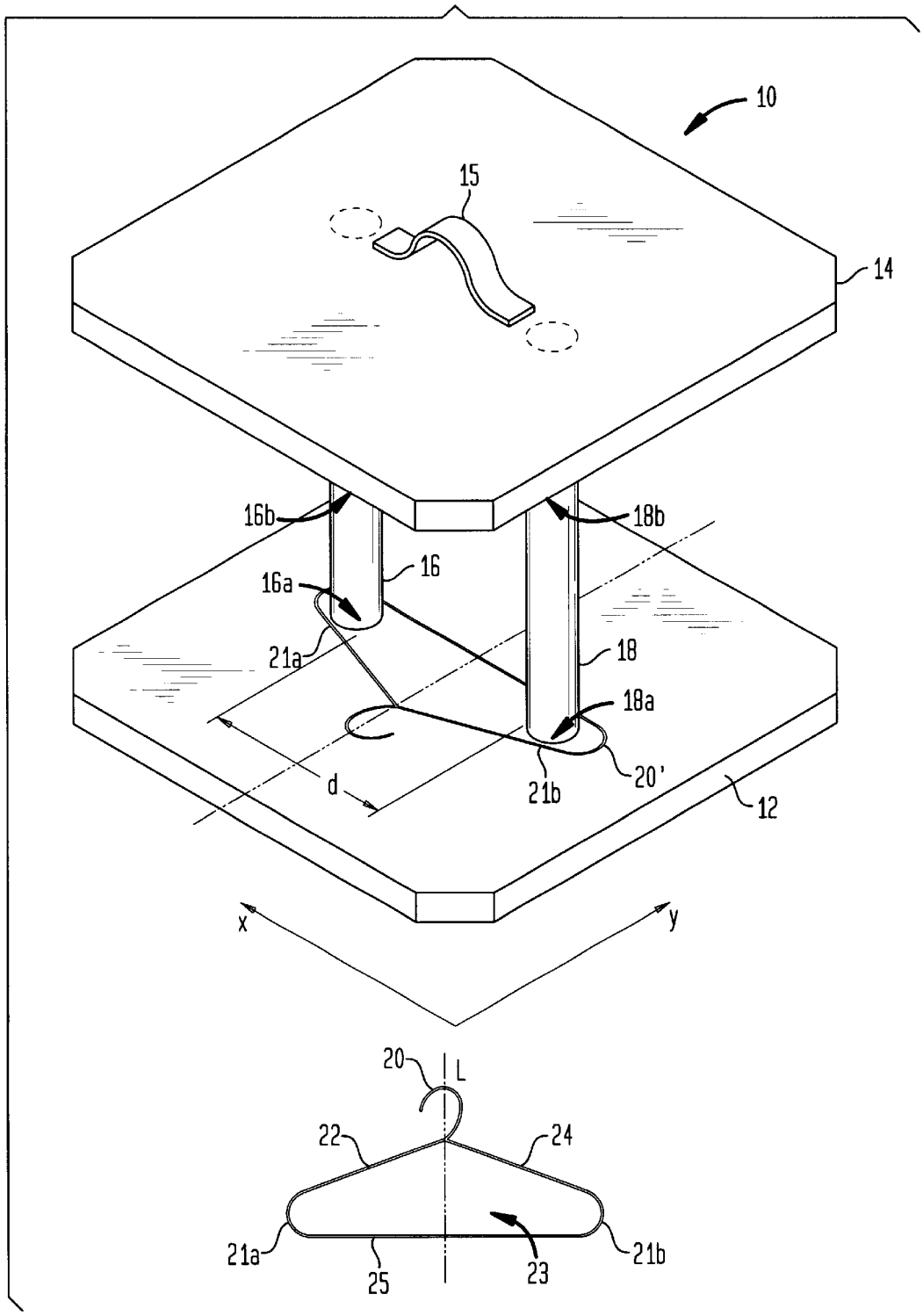
FIG. 1 illustrates a perspective view of one embodiment of the hanger packaging and display apparatus together with a hanger.

Referring to FIG. 1, there is shown a perspective frontal view of one embodiment of the packaging assembly 10 with one hanger 20 placed thereon. The hanger 20 is shown as a traditional triangular hanger having two side arms 22, 24 and a traverse bar 25 that define an inner framed-space 23. The hanger has a longitudinal central axis L intersecting the framed-space 23. The assembly is adapted for use with such hangers, i.e., those having a framed-space. The assembly comprises a bottom 12 and top platform 14 that preferably are substantially planar, as shown. The top platform 14 may have one or more handles 15 for easy removal of the top platform, and it also may have ornamental features thereon to enhance its appearance for store display. However, the bottom platform is intended to rest on the ground and thus should have a substantially flat bottom surface. Also, making the top platform substantially planar with flat surfaces makes it easier to stack a number of assemblies on top of one another which is convenient for shipping.

At least two rods 16, 18 of substantially equal length are vertically disposed between the top and bottom platforms. Each of the at least two rods has a bottom end 16*a*, 18*a* and a top end 16*b*, 18*b*. The bottom end of each rod is mounted on the bottom platform 12 and the top end of each rod is fitted to the top platform 14. Preferably, the bottom ends 16*a*, 18*a* are permanently affixed to the bottom, whereas the top end of each rod 16*b*, 18*b*, is removably fitted to the top platform 14 so that the top can be easily removed and placed back on the assembly by a consumer in a store.

The rods 16, 18 are spaced-apart in relation to each other so that they can securely maintain the hanger 20 on the assembly. In particular, the bottom platform 12 has a horizontal plane of symmetry defined by x and y axes as shown in FIG. 1. The distance d between the rods should be sufficient that when a hanger is placed flatly on the bottom platform, e.g., along a plane aligned with the horizontal plane of symmetry, as shown at 20', the two rods are situated in the framed-space 23 of the hanger 20' on opposite sides of its central longitudinal axis L. In this way, the hanger is retained on the bottom platform. Preferably, the rods should be of sufficient height that a plurality of hangers may be stacked (e.g., one on top of another above hanger 20'). The hangers are thus stacked one on top of another along planes aligned with the horizontal plane of symmetry of the bottom platform and retained by the rods between the top and bottom platforms.

At least two rods should be used and placed on opposite sides of axis L so that the hangers are maintained securely to the assembly, e.g., so they do not spin about the rods. Also, the closer the rods are placed to the corners 21*a,* 21*b* of the hangers (at the intersection of the traverse bar 25 and side arms 22, 24), the less likely it is that they hangers will move about on the display. However, any additional numbers of rods may be used and oriented at different locations within the framed-space 23. In a preferred embodiment, four rods are used, which is shown in FIGS. 2, 3A–3B, 4 and 6. In this way, space is used most efficiently and yet an interesting design of hangers may be created when the hangers are alternatively stacked, as in FIGS. 4 and 6. Preferably, plastic tubular hangers are used having different colors, and a new color is used for different stacks of hangers or levels of stacking so that a patterned design is created.

Figure 2:
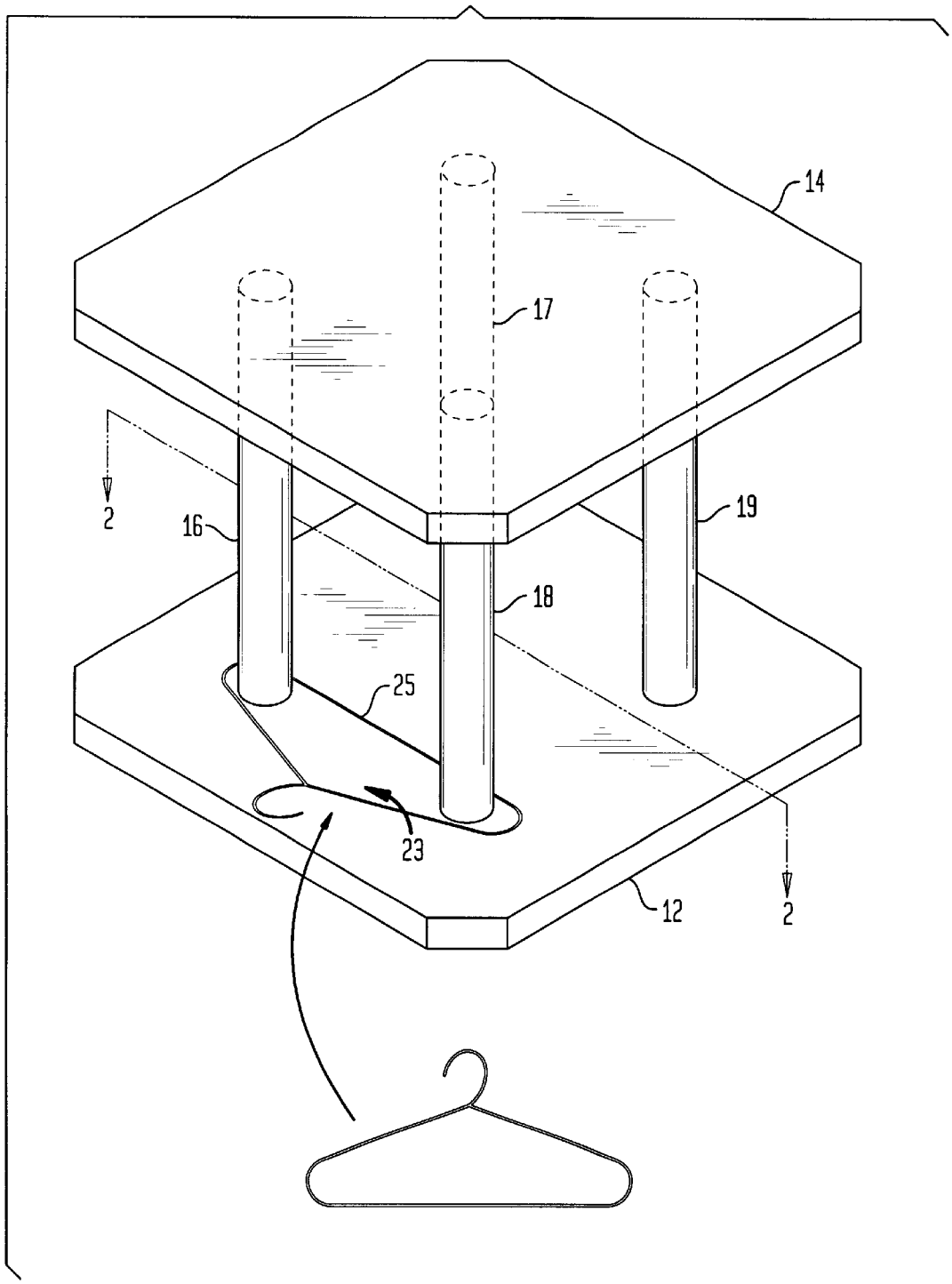
FIG. 2 illustrates a perspective view of an alternative embodiment of the hanger packaging and display apparatus together with a hanger.

More particularly, in FIG. 2 there is shown the hanger package and display assembly 10 comprising a bottom 12 and a top 14 platform, and four rods 16, 17, 18, 19 of substantially equal length. Each of the four rods has a top end (16*a,* 17*a,* 18*a,* 19*a*) and a bottom end, wherein the bottom end of each rod is mounted on the bottom platform and the top end of each rod is fitted to the top platform. Looking at FIGS. 2 and 4, the top platform can have a depth with indentations therein 36, 37, 38, 39 for frictionally engaging each of the top ends of the rods. (The depth of the indentations are shown with hatched lines). In other words, each rod has a circumference and for each one of the rods, the top platform has a corresponding indentation therein having a diameter sized in relation to the circumference so that each one of the indentations can frictionally engage one of the rods. Notably, the terms "circumference" and "diameter" are used here generically and are not intended to foreclose use of rods that have other than a cylindrical shape. For example, the rods may be formed of elongated cubes, although cylindrical rods are preferred.

Figure 3A:
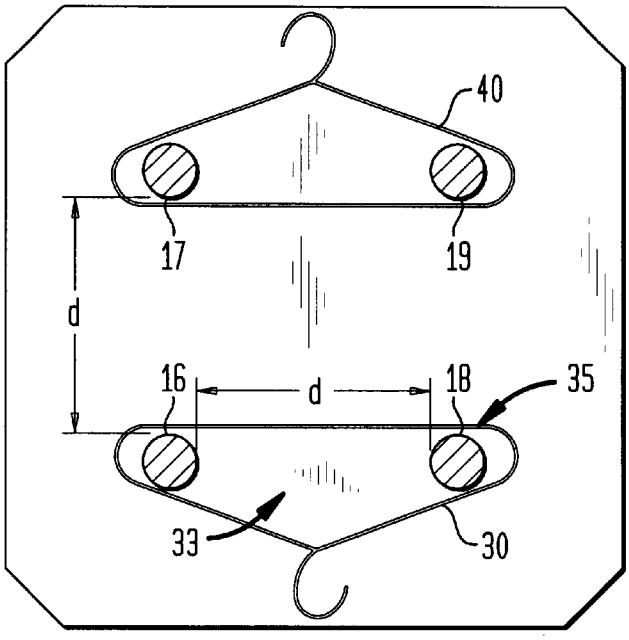
FIGS. 3A–3B are cross-sectional views looking downward at the apparatus along the line 2—2 of FIG. 2, illustrating alternative stacking of hangers on the apparatus.
Figure 3B:
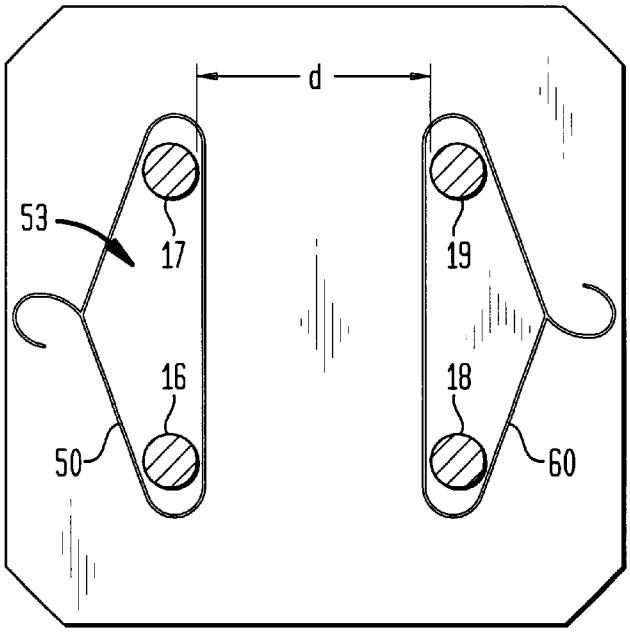
Figure 4:
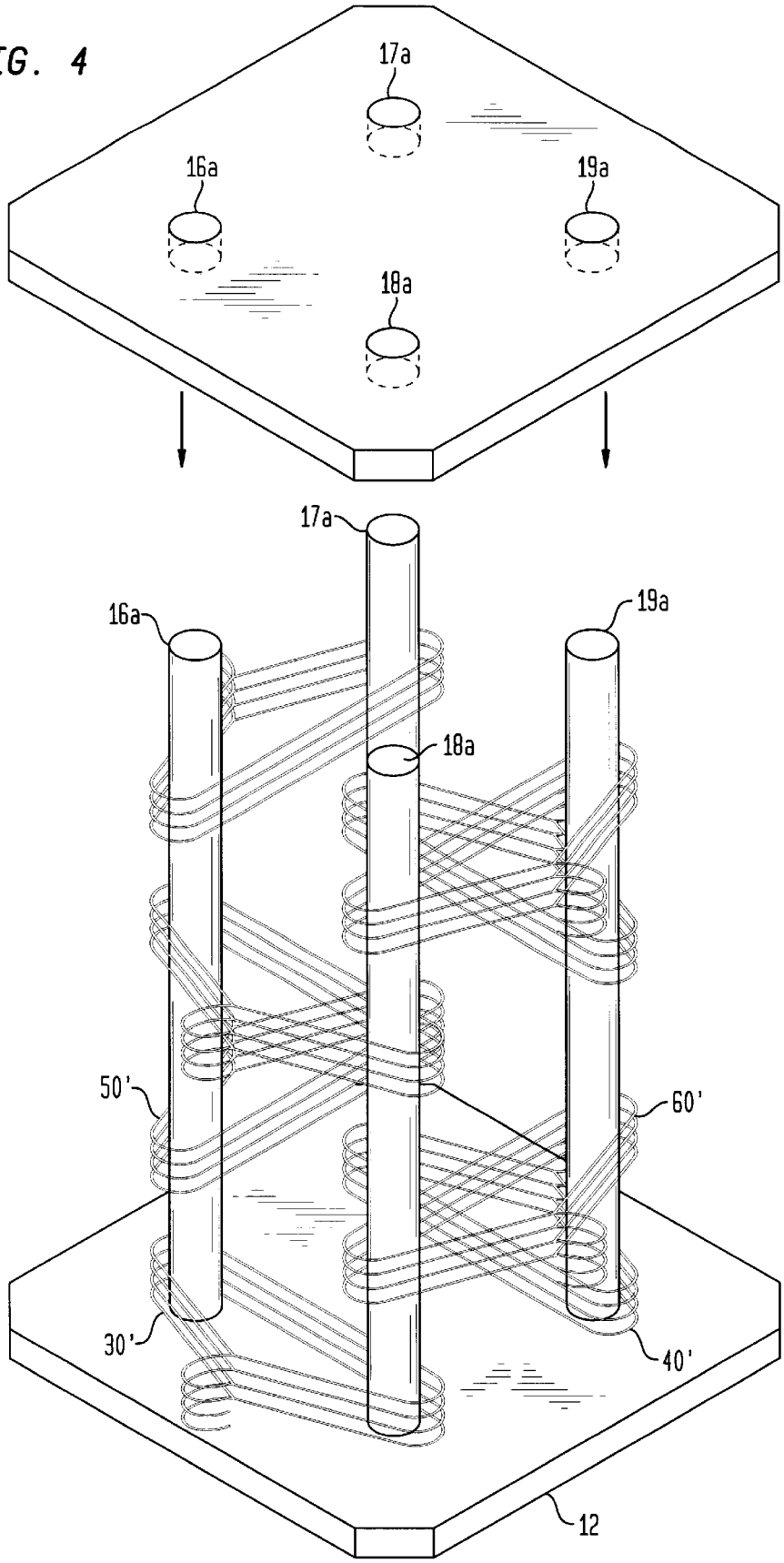
FIG. 4 is a perspective view of the hanger packaging and display apparatus together with a plurality of hangers stacked thereon and the top platform removed.

FIGS. 3A–3B and FIG. 4 illustrate how the hangers can be alternatively stacked when four rods are used, as preferred. Each one of the four rods is oriented in spaced-apart relation to each other by a distance "d." Looking at FIG. 3A, the distance "d" is sufficient that when a first hanger 30 is placed along a plane aligned with the horizontal plane of symmetry of the bottom platform 12, two of the four rods 16, 18 defining a first pair are situated in the framed-space 33 of the first hanger on opposite sides of the central longitudinal axis of the first hanger 33. The traverse bar 35 of the first hanger is disposed between the first pair of rods 16, 18 and the other two of the four rods 17, 19 that define a second pair of rods. Looking at FIG. 3B, a second hanger 50 can be alternatively stacked relative to the first hanger 30. By "alternatively stacked" it is meant that one of the first pair 16 and one of the second pair 17 of rods is situated in the framed-space 53 of the second hanger 50 on opposite sides of its central longitudinal axis, and the traverse bar 55 of the second hanger is oriented between (i) one of the first pair 16 and one of the second pair 17 and (ii) the other of the first pair 18 and the other of the second pair 19 of rods.

Preferably, the four rods are of sufficient height that a plurality of hangers may be stacked and retained by the four rods between the top and bottom platforms, as shown in FIG. 4. As can be seen in FIG. 4, when the hangers are stacked alternatively on the assembly, an aesthetically-pleasing design is created. By using differently-colored hangers, a colorful patterned design can be formed. For example, in FIG. 4, first and second stacks 30', 40' of hangers can be made of one color, while the third and fourth stacks 50', 60' are of another color. Or the first and third stacks 30', 50' can be of one color, while the second and fourth stacks 40', 60' are of another color. Any variety of different colors can be used to create a number of different designs.

Figure 5A:
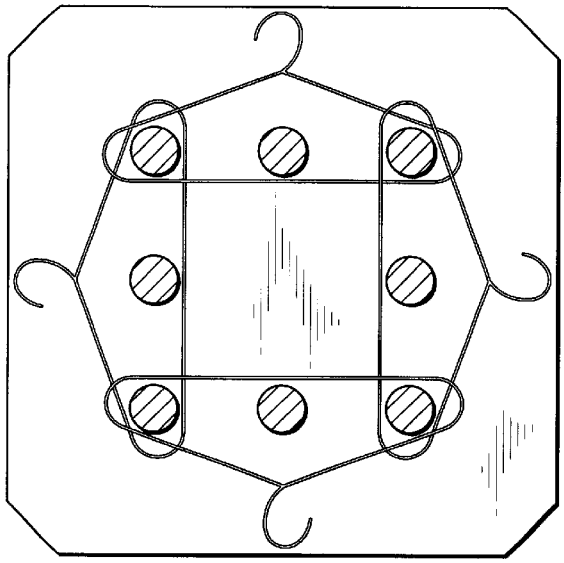
FIGS. 5A–5B are cross-sectional views looking downward at the apparatus as in FIGS. 3A–3B, illustrating different numbers of rods used for the display.
Figure 5B:
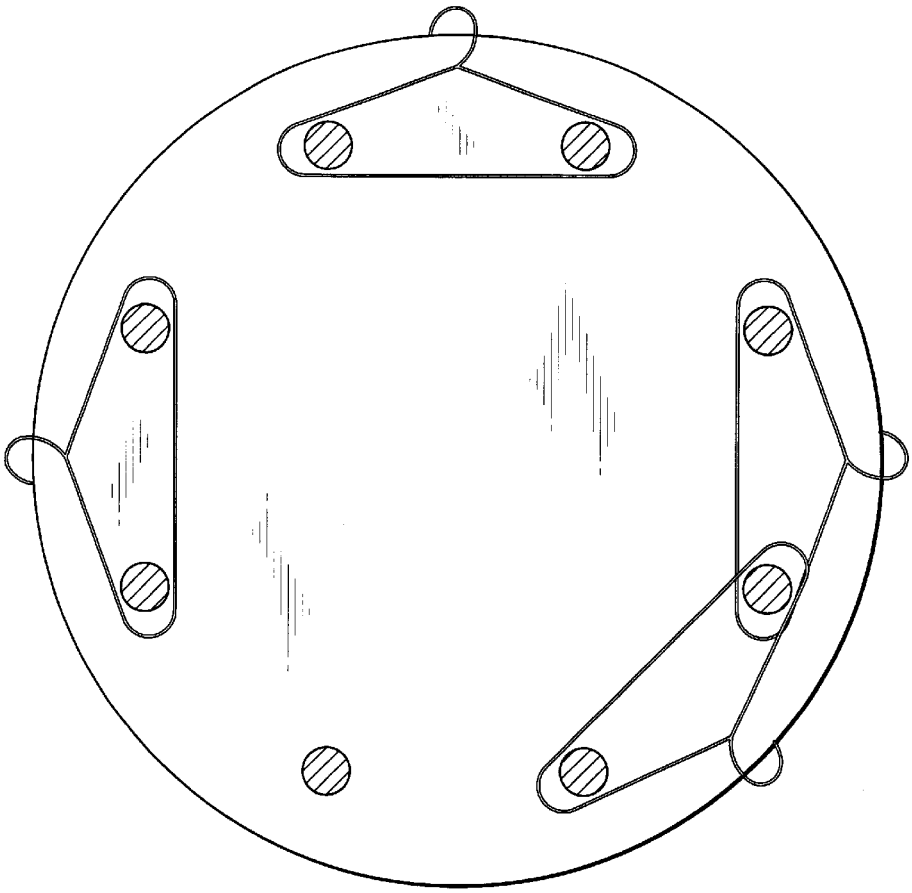

Although four rods are preferred, different numbers of rods can be used and arranged on the platforms in various patterns to make new designs. For example, FIG. 5A shows six rods arranged in a square configuration, and FIG. 5B shows eight rods arranged in a circular pattern. FIG. 5B is advantageous in terms of providing a pretty display, although it consumes more space than the embodiment of FIG. 4, showing four rods.

Figure 6:
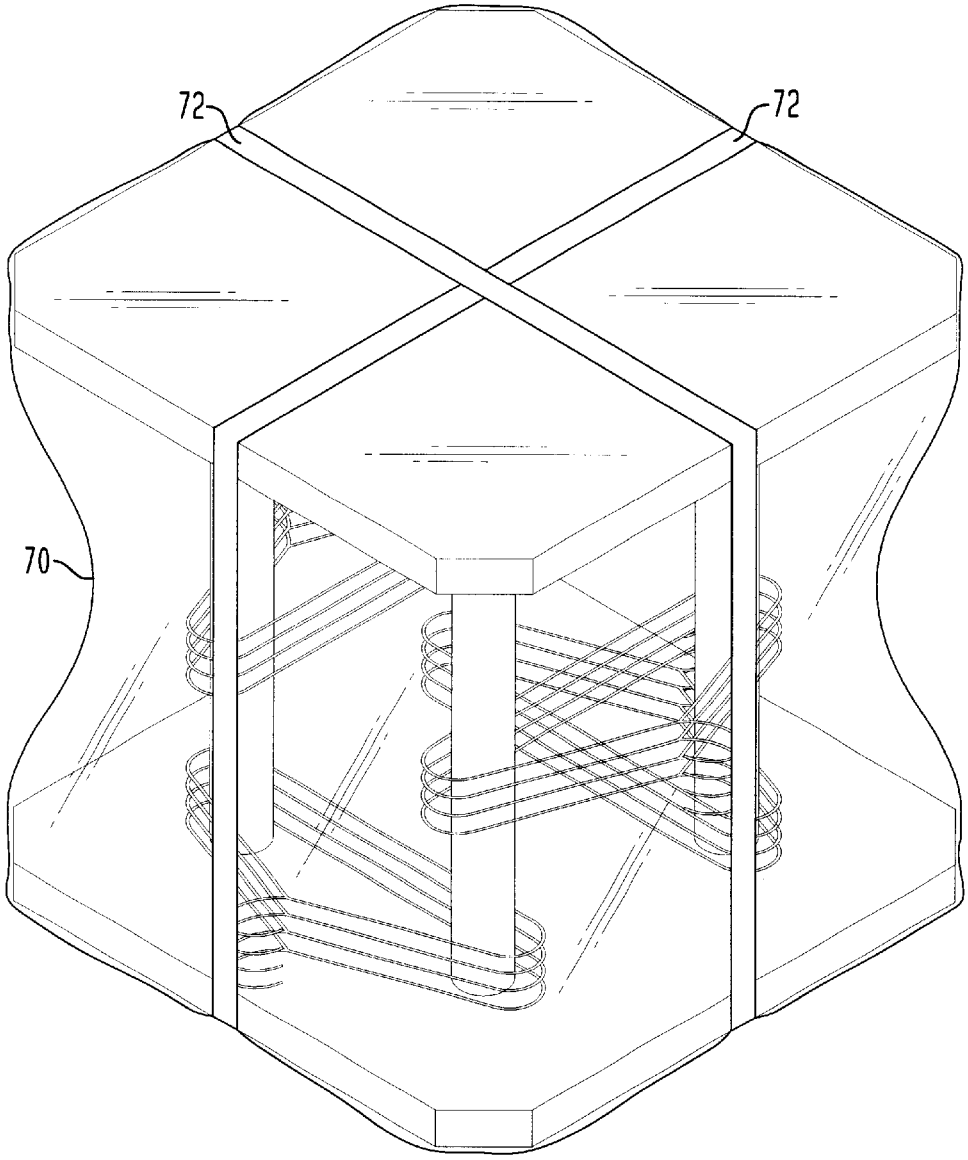
FIG. 6 is a perspective view of the hanger packaging and display apparatus with a plurality of hangers ready for shipping.

Referring to FIG. 6, preferably the assembly including the plurality of stacked hangers is encased in plastic wrap 70, and held together with straps 72, to provide added security during shipping. Plastic materials known in the field may be used for these features. With this wrapping, a store clerk need only remove the straps 72 and the plastic wrap 70, and the hangers are ready for display in the store. The top platform 14 can be removed with the hangers displayed as in FIG. 4, or it can be removably fitted on the assembly with the consumers themselves then detaching the top from the assembly to retrieve the hangers they desire to purchase.

It is understood that the embodiments described herein are merely exemplary and that a person skilled in the art may make variations and modifications without departing from the spirit and scope of the invention. All such variations and modifications are intended to be included within the scope of the appended claims.

I claim:

1. A hanger package and display assembly comprising:

top and bottom platforms;

at least two rods of substantially equal length, each of the at least two rods having a top end and a bottom end, wherein the bottom end of each rod is mounted on the bottom platform and the top end of each rod is adapted to be attached to the top platform whereby the at least two rods are vertically disposed between the top and bottom platforms, each of the at least two rods being in spaced-apart relation to each other of the at least two rods by a sufficient distance that when a hanger, defining a framed-space and having a central longitudinal axis, is placed along a plane aligned with the horizontal plane of symmetry of the bottom platform, the at least two rods are situated in the framed-space of the hanger on opposite sides of the central longitudinal axis of the hanger and thereby retained on the bottom platform, the at least two rods further each being of sufficient height that a plurality of hangers may be stacked and retained by the at least two rods between the top and bottom platforms;

wherein the top ends of each of the at least two rods are removably fitted to the top platform so that a user can readily remove the tog platform from the display and put the top platform back on the display.

2. The hanger package and display assembly of claim 1 in which the top and bottom platforms are substantially planar.

3. The hanger package and display assembly of claim 1 in which the rods are cylindrical.

4. The hanger package and display assembly of claim 1 comprising three rods oriented along the points of a triangle.

5. The hanger package and display assembly of claim 1 comprising four rods oriented along the corners of a square.

6. The hanger package and display assembly of claim 1 comprising a multiplicity of rods.

7. A hanger package and display assembly comprising:

top and bottom platforms;

at least two rods of substantially equal length, each of the at least two rods having a top end and a bottom end, wherein the bottom end of each rod is mounted on the bottom platform and the top end of each rod is adapted to be attached to the top platform whereby the at least two rods are vertically disposed between the top and bottom platforms, each of the at least two rods being in spaced-apart relation to each other of the at least two rods by a sufficient distance that when a hanger, defining a framed-space and having a central longitudinal axis, is placed along a plane aligned with the horizontal plane of symmetry of the bottom platform, the at least two rods are situated in the framed-space of the hanger on opposite sides of the central longitudinal axis of the hanger and thereby retained on the bottom platform, the at least two rods further each being of sufficient height that a plurality of hangers may be stacked and retained by the at least two rods between the top and bottom platforms;

wherein each of the at least two rods has a circumference and for each one of the at least two rods, the top platform has a corresponding indentation therein having a diameter sized in relation to the circumference so that each one of the indentations can frictionally engage one of the at least two rods.

8. A hanger package and display assembly comprising:

top and bottom platforms;

at least two rods of substantially equal length, each of the at least two rods having a top end and a bottom end, wherein the bottom end of each rod is mounted on the bottom platform and the top end of each rod is adapted to be attached to the top platform whereby the at least two rods are vertically disposed between the top and bottom platforms, each of the at least two rods being in spaced-apart relation to each other of the at least two rods by a sufficient distance that when a hanger, defining a framed-space and having a central longitudinal axis, is placed along a plane aligned with the horizontal plane of symmetry of the bottom platform, the at least two rods are situated in the framed-space of the hanger on opposite sides of the central longitudinal axis of the hanger and thereby retained on the bottom platform, the at least two rods further each being of sufficient height that a plurality of hangers may be stacked and retained by the at least two rods between the top and bottom platforms;

in combination with a plurality of hangers stacked on the assembly and a plastic wrap encasing the assembly.

* * * * *